US011794480B2

(12) United States Patent
Tsuji et al.

(10) Patent No.: US 11,794,480 B2
(45) Date of Patent: Oct. 24, 2023

(54) HEAD UNIT AND INKJET RECORDING APPARATUS

(71) Applicant: KYOCERA Document Solutions Inc., Osaka (JP)

(72) Inventors: Kikunosuke Tsuji, Osaka (JP); Ryo Matsuyama, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/695,028

(22) Filed: Mar. 15, 2022

(65) Prior Publication Data

US 2022/0297435 A1 Sep. 22, 2022

(30) Foreign Application Priority Data

Mar. 18, 2021 (JP) ..... 2021-044322

(51) Int. Cl.
*B41J 2/175* (2006.01)
*B41J 2/18* (2006.01)

(52) U.S. Cl.
CPC ..... *B41J 2/175* (2013.01); *B41J 2/18* (2013.01); *B41J 2202/12* (2013.01)

(58) Field of Classification Search
CPC ... B41J 2/18; B41J 2/175; B41J 2/1714; B41J 2202/12
See application file for complete search history.

(56) References Cited

U.S. PATENT DOCUMENTS 8,876,247 B2 * 11/2014 Kobayashi ..... B41J 29/393 347/17
9,931,845 B2 * 4/2018 Moriya ..... B41J 2/1404
11,241,881 B2 * 2/2022 Eto ..... B41J 29/38

FOREIGN PATENT DOCUMENTS

JP 2000-343720 12/2000

* cited by examiner

*Primary Examiner* — An H Do
(74) *Attorney, Agent, or Firm* — LEX IP MEISTER, PLLC

(57) ABSTRACT

A head unit includes a plurality of recording heads and a liquid supply unit. The liquid supply unit includes a body housing, an external connection port, and a head connection port. A body housing is positioned above the nozzles of the plurality of recording heads and has thereinside a common flow path through which the liquid passes. An external connection port is provided in the body housing, communicates with one end of the common flow path, is connected to an external liquid supply source, and through which the liquid passes. A head connection port is provided in the body housing and communicates with the other end side of the common flow path, is connected to each of the plurality of recording heads, and through which the liquid passes.

7 Claims, 9 Drawing Sheets

HEAD UNIT AND INKJET RECORDING APPARATUS

INCORPORATION BY REFERENCE

This application is based upon and claims the benefit of priority from the corresponding Japanese Patent Application No. 2021-44322 filed on Mar. 18, 2021, the entire contents of which are incorporated herein by reference.

BACKGROUND

The present disclosure relates to a head unit and an inkjet recording apparatus.

A head unit mounted on an inkjet recording apparatus includes a recording head having a plurality of nozzles for ejecting ink onto a recording medium such as paper, and records an image on the recording medium.

The inkjet recording apparatus includes an inkjet recording head capable of ejecting ink from a plurality of nozzles. The inkjet recording head is provided with first, second, third, fourth and fifth ink flow paths for supplying ink to a plurality of nozzles. The base end of the first flow path and the base end of the fourth ink flow path located at the upper end of the inkjet recording head are connected to an external ink supply path and an ink circulation path.

SUMMARY

A head unit includes a plurality of recording heads and a liquid supply unit.

The plurality of recording heads have a plurality of nozzles which eject ink onto a recording medium.

A liquid supply unit supplies one or more kinds of liquid including the ink to the plurality of recording heads.

The liquid supply unit includes a body housing, an external connection port, and a head connection port.

A body housing is positioned above the nozzles of the plurality of recording heads and has thereinside a common flow path through which the liquid passes.

An external connection port is provided in the body housing, communicates with one end of the common flow path, is connected to an external liquid supply source, and through which the liquid passes.

A head connection port is provided in the body housing and communicates with the other end side of the common flow path, is connected to each of the plurality of recording heads, and through which the liquid passes.

DETAILED DESCRIPTION

Embodiments of the present disclosure will be described below with reference to the drawings. The present disclosure is not limited to the following.

Figure 1:
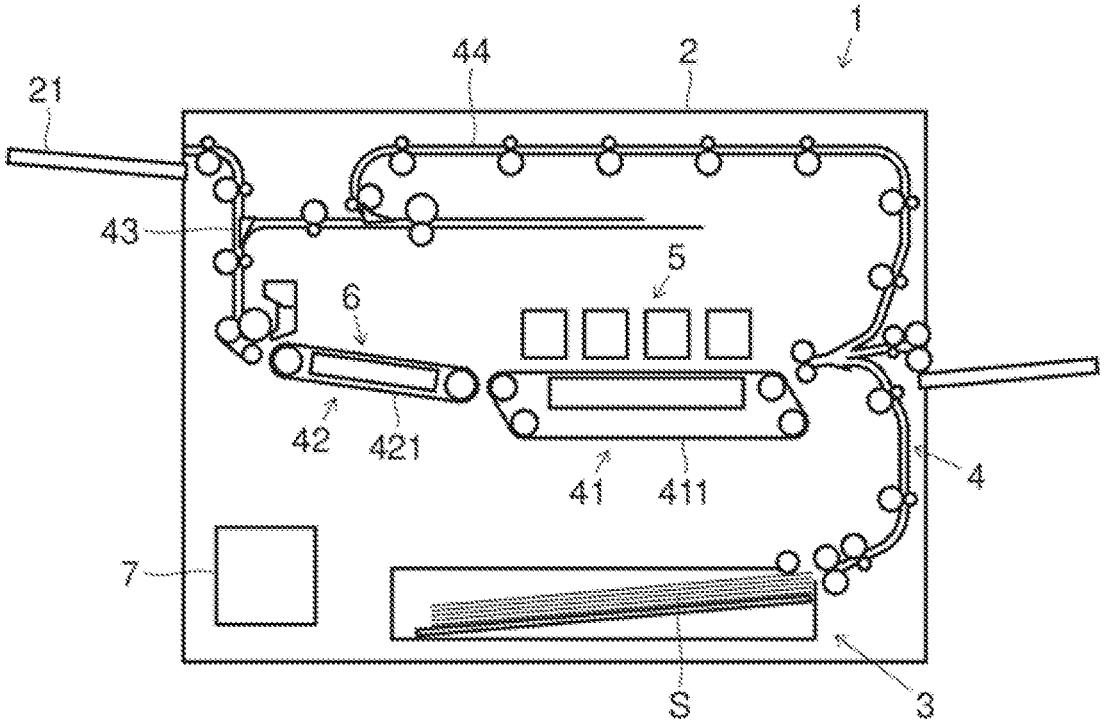
FIG. 1 is a schematic cross-sectional front view of an inkjet recording apparatus according to an embodiment of the present disclosure.
Figure 2:
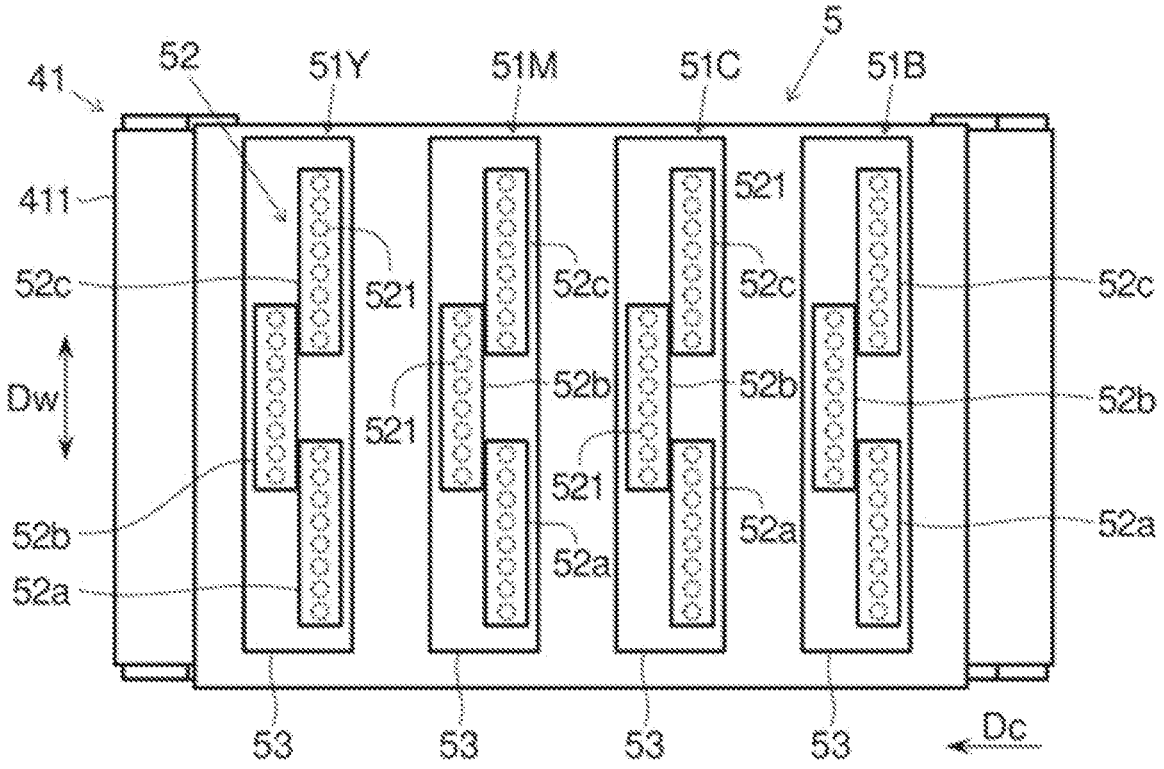
FIG. 2 is a top view of the recording unit of the inkjet recording apparatus of FIG. 1.

FIG. 1 is a schematic cross-sectional front view of the inkjet recording apparatus 1 of the embodiment. FIG. 2 is a top view of the recording unit 5 of the inkjet recording apparatus 1 shown in FIG. 1. The inkjet recording apparatus 1 is, for example, an inkjet recording type printer. As shown in FIGS. 1 and 2, the inkjet recording apparatus 1 includes an apparatus body 2, a sheet supply unit 3, a sheet conveying unit 4, a recording unit 5, a drying unit 6, and a control unit 7.

A sheet supply unit 3 stores a plurality of sheets (recording media) S, and separates the sheets S one by one and sends them out during recording. The sheet conveying unit 4 conveys the sheet S fed from the sheet supply unit 3 to the recording unit 5 and the drying unit 6, and further discharges the sheet S after recording and drying to the sheet discharge unit 21. When double-sided recording is performed, the sheet conveying unit 4 distributes the sheet S after recording and drying of the first surface, to the reversal conveying unit 44 by the branch unit 43, and further conveys the sheet S whose front and rear sides are reversed by switching the conveyance direction, to the recording unit 5 and the drying unit 6 again.

The sheet conveying unit 4 includes a first belt conveying unit 41 and a second belt conveying unit 42. The first belt conveying unit 41 has a first conveying belt 411 formed in an endless shape. The second belt conveying unit 42 has a second conveying belt 421 formed in an endless shape. The first belt conveying unit 41 and the second belt conveying unit 42 suck and hold the sheet S on the upper outer surfaces (upper surfaces) of the first conveying belt 411 and the second conveying belt 421 and convey it. A first belt conveying unit 41 is arranged below the recording unit 5 and conveys the sheet S. The second belt conveying unit 42 is located downstream of the first belt conveying unit 41 in the sheet conveyance direction, and is arranged in the drying unit 6 to convey the sheet S.

The recording unit 5 faces the sheet S sucked and held on the upper surface of the first conveying belt 411 and conveyed, and is arranged above the first conveying belt 411 at a predetermined interval. As shown in FIG. 2, the recording unit 5 holds head units 51B, 51C, 51M, and 51Y corresponding to the four colors of black, cyan, magenta, and yellow, respectively. The head units 51B, 51C, 51M and 51Y are juxtaposed along the sheet conveyance direction Dc so that the longitudinal direction is parallel to the sheet width direction Dw orthogonal to the sheet conveyance direction Dc. Since the basic configurations of the 4 head units 51B, 51C, 51M, and 51Y are the same, the identification symbols "B", "C", "M", and "Y" representing the respective colors may be omitted in the following description, except when it is particularly necessary to restrict them.

Each of the head units 51 of each color has a line type inkjet recording head 52. A plurality of recording heads 52 (for example, three recording heads (52*a*, 52*b*, 52*c*)) are arranged in a zigzag manner along a sheet width direction Dw in each head unit 51 of each color.

The recording head 52 has a plurality of ink ejection nozzles 521 at its bottom. The plurality of ink ejection nozzles 521 are arranged side by side along the sheet width direction Dw, and can eject ink over the entire area of the recording region on the sheet S. That is, the recording head 52 has a plurality of ink ejection nozzles 521 for ejecting ink onto the sheet S. The recording unit 5 sequentially ejects ink from the recording heads 52 of the head units 51B, 51C, 51M and 51Y of four colors toward the sheet S conveyed by the first conveying belt 411, and records a full color image or a monochrome image on the sheet S.

The drying unit 6 is arranged on the downstream side in the sheet conveyance direction with respect to the recording unit 5, and a second belt conveying unit 42 is provided. While the sheet S on which the ink image is recorded in the recording unit 5 is sucked and held by the second conveying belt 421 and conveyed in the drying unit 6, the ink is dried.

The control unit 7 includes a CPU, a storage unit, other electronic circuits, and electronic components (not shown). The CPU controls the operation of each component provided in the inkjet recording apparatus 1 based on the control program and data stored in the storage unit to perform processing related to the function of the inkjet recording apparatus 1. Each of the sheet supply unit 3, the sheet conveying unit 4, the recording unit 5 and the drying unit 6 receives a command individually from the control unit 7 and performs recording on the sheet S in cooperation with each other. The storage unit is composed of a combination of a nonvolatile storage device such as a program ROM (Read Only Memory) or a data ROM and a volatile storage device such as a RAM (Random Access Memory).

Figure 3:
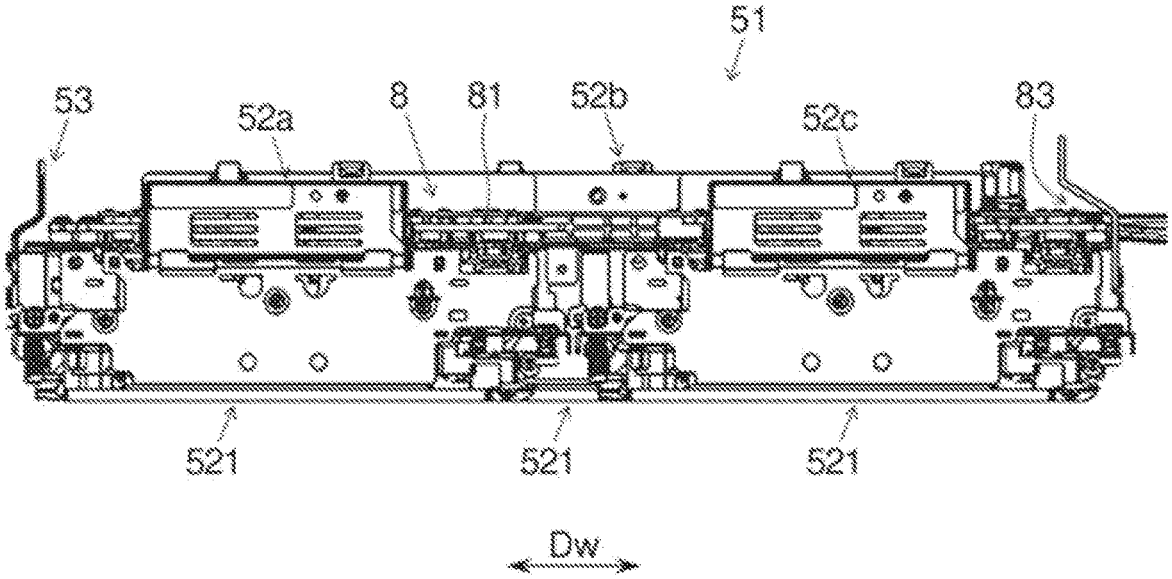
FIG. 3 is a side view of the head unit of the recording unit shown in FIG. 2.
Figure 4:
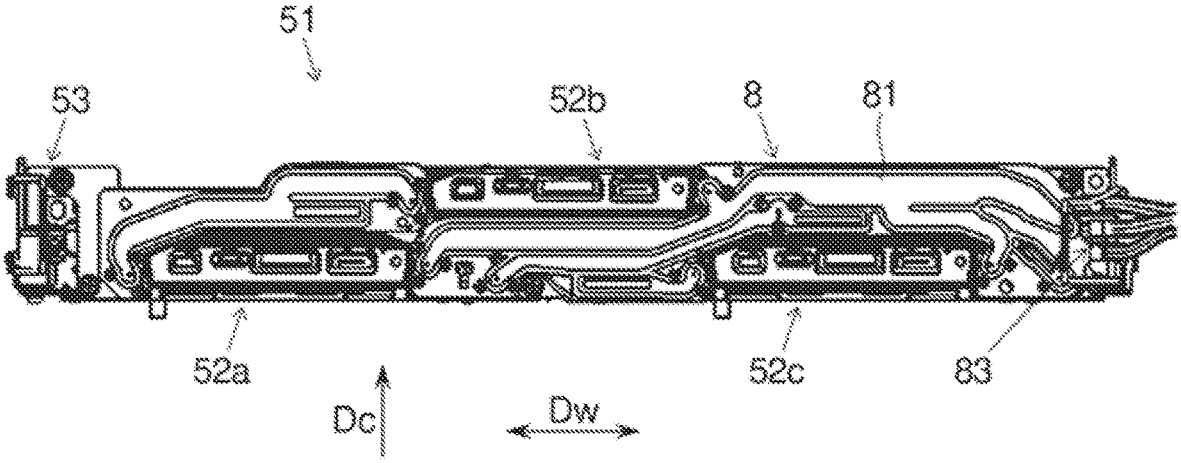
FIG. 4 is a top view of the head unit of the recording unit shown in FIG. 2.
Figure 5:
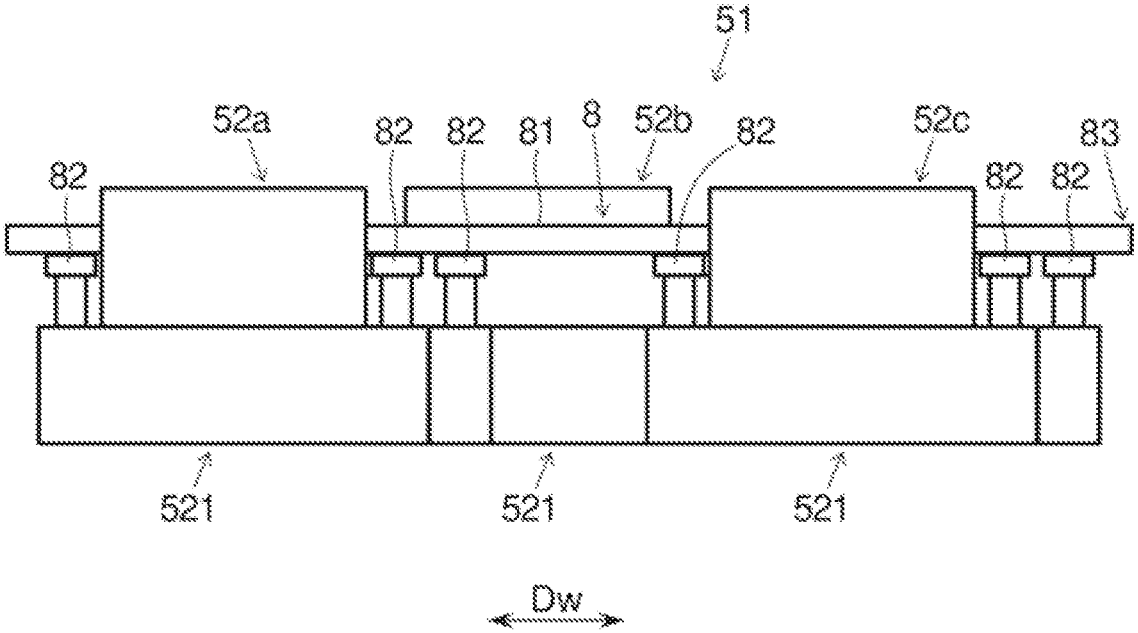
FIG. 5 is a schematic side view of the head unit of FIG. 3.

Next, the configuration of the head unit 51 of the inkjet recording apparatus 1 will be further described with reference to FIGS. 3, 4, and 5 in addition to FIG. 2. FIGS. 3 and 4 are side views and top views of the head unit 51 of the recording unit 5 in FIG. 2. FIG. 5 is a schematic side view of the head unit 51 of FIG. 3.

The head unit 51 includes a frame 53 and a liquid supply unit 8 in addition to the three recording heads 52*a*, 52*b* and 52*c*.

The frame 53 holds the three recording heads 52*a*, 52*b*, and 52*c*. The three recording heads 52*a*, 52*b* and 52*c* are arranged in a zigzag manner along the sheet width direction Dw. The recording heads 52*a* and 52*c* are juxtaposed in the sheet width direction Dw at the upstream portion of the sheet conveyance direction Dc of the head unit 51. The recording head 52*b* is located downstream of the head unit 51 in the sheet conveyance direction Dc and between the recording heads 52*a* and 52*c* in the sheet width direction Dw.

The liquid supply unit 8 overlaps the upper part of the recording head 52 when viewed from the sheet conveyance direction Dc and the sheet width direction Dw. The liquid supply unit 8 is connected to the three recording heads 52*a*, 52*b*, and 52*c*. The liquid supply unit 8 supplies one or more kinds of liquid including ink to the three recording heads 52*a*, 52*b*, and 52*c*. In this embodiment, the liquid supply unit 8 supplies ink and a cleaning liquid for cleaning the ink ejection surface of the recording head 52 to the recording head 52. The liquid supply unit 8 has a body housing 81 and a joint mechanism 82.

The body housing 81 is positioned above the ink ejection nozzles 521 of the three recording heads 52*a*, 52*b*, and 52*c*. The body housing 81 extends over an upper portion of each of the three recording heads 52*a*, 52*b*, and 52*c* in the sheet width direction Dw.

The joint mechanism 82 is disposed below the body housing 81. The joint mechanism 82 is fixed to the lower surface of the body housing 81 and extends downward. The lower part of the joint mechanism 82 is detachably connected to the recording head 52. The joint mechanism 82 has a liquid flow path through which the liquid passes.

Three joint mechanisms 82 are provided for one recording head 52. That is, the liquid supply unit 8 has nine joint mechanisms 82. Two of the three joint mechanisms 82 for each recording head 52 are arranged at one end side in the sheet width direction Dw of the recording head 52, and one is arranged at the other end side.

Figure 6:
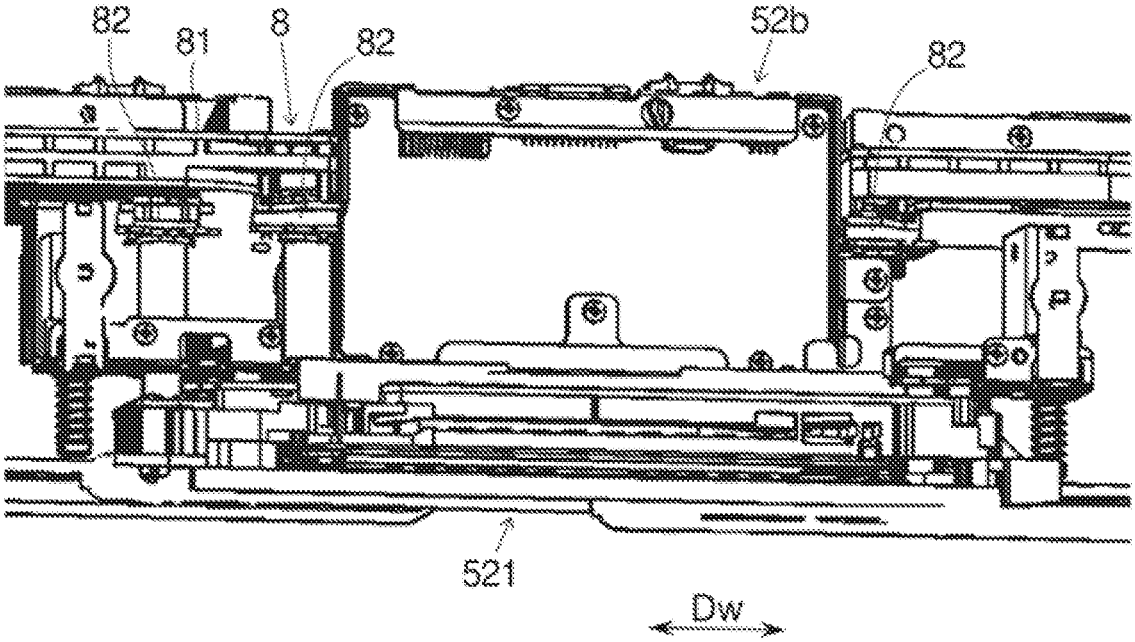
FIG. 6 is a perspective view of the recording head of the head unit of FIG. 3.
Figure 7:
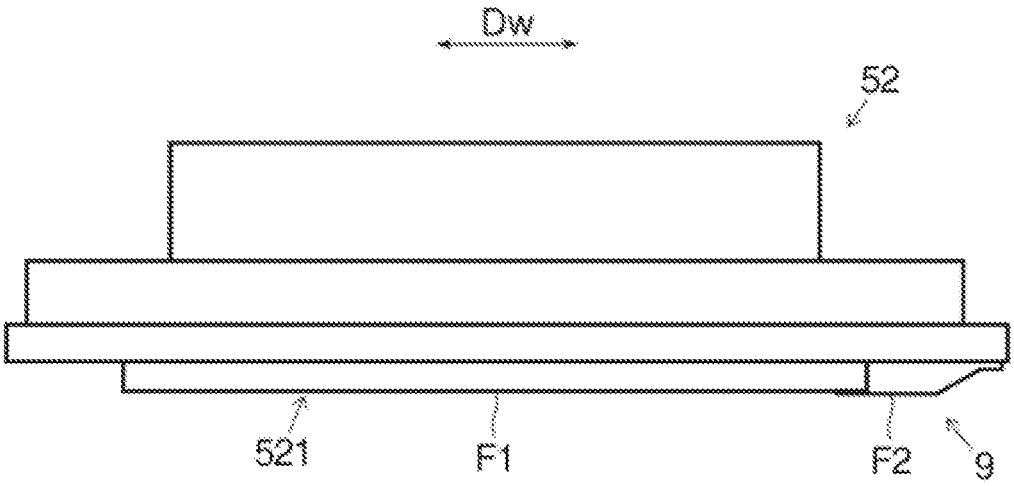
FIG. 7 is a schematic side view of the recording head of FIG. 6.
Figure 8:
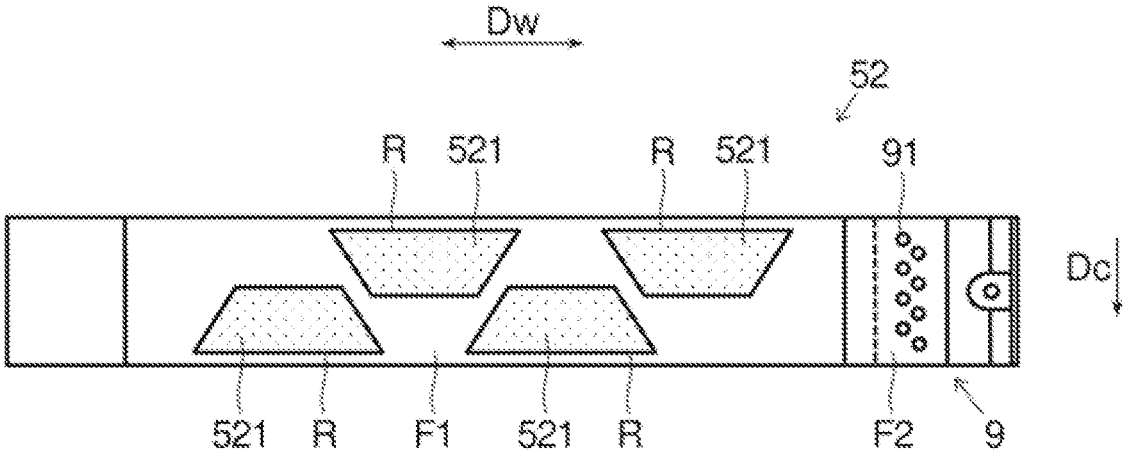
FIG. 8 is a schematic bottom view of the recording head of FIG. 6.

Next, the configuration of the recording head 52 of the head unit 51 will be further described with reference to FIGS. 6, 7, and 8. FIG. 6 is a perspective view of the recording head 52 of the head unit 51 of FIG. 3. FIGS. 7 and 8 are schematic side views and schematic bottom views of the recording head 52 of FIG. 6. Since the three recording heads 52*a*, 52*b*, and 52*c* of each color have the same shape and configuration, the description of the identification symbol (a, b, c) is omitted in the following description.

As shown in FIG. 7, the recording head 52 has an ink ejection surface F1 on its lower surface. As shown in FIG. 8, the ink ejection surface F1 has a nozzle region R in which a large number of ink ejection nozzles 521 are arranged. That is, the ink ejection surface F1 is opened by a large number of ink ejection nozzles 521. A water repellent film (not shown) is formed on the ink ejection surface F1. To each of the recording heads 52 of four colors (Black, cyan, magenta, and yellow), ink of four colors stored in an ink tank (liquid supply source) outside the head unit 51 is supplied individually for each color through a liquid supply unit 8.

The recording head 52 ejects ink from the ink ejection nozzle 521 toward the sheet S sucked and held on the conveyance surface of the first conveying belt 411 and conveyed in accordance with the image data received from the external computer based on the control signal from the control unit 7. Thus, on the sheet S on the first conveying belt 411, a color image in which inks of four colors of black, cyan, magenta and yellow are superimposed is formed.

As shown in FIGS. 7 and 8, a cleaning liquid supply unit 9 is provided at one end of the recording head 52 in the sheet width direction Dw. The cleaning liquid supply unit 9 is arranged adjacent to the recording head 52 at one end side in the sheet width direction Dw of the recording head 52.

The cleaning liquid supply unit 9 has a cleaning liquid supply surface F2 on the lower surface. The cleaning liquid supply surface F2 is parallel to the ink ejection surface F1 and adjacent to the ink ejection surface F1 along the sheet width direction Dw. A region of the cleaning liquid supply surface F2 adjacent to the ink ejection surface F1 is formed in a thin plate shape, and is arranged under the ink ejection surface F1 so as to overlap with each other. A water repellent film (not shown) is formed on the cleaning liquid supply surface F2.

Many cleaning liquid supply ports 91 are opened on the cleaning liquid supply surface F2. A large number of cleaning liquid supply ports 91 are arranged in a zigzag manner along, for example, a sheet conveyance direction Dc. The cleaning liquid supply port 91 supplies the cleaning liquid to the cleaning liquid supply surface F2. The cleaning liquid is carried to the ink ejection surface F1 by a wiper (not shown) disposed below the recording head 52 and moving in the sheet width direction Dw. That is, the cleaning liquid supply unit 9 supplies the cleaning liquid carried to the ink ejection surface F1.

The cleaning liquid is preferably a solution having a component similar to that of ink containing no coloring material. The cleaning liquid is a liquid composition composed of a solvent component and water, to which a surfactant, a preservative, a fungicide or the like is added as necessary. The cleaning liquid is excellent in cleaning of ink and solubility of solidified ink.

Figure 9:
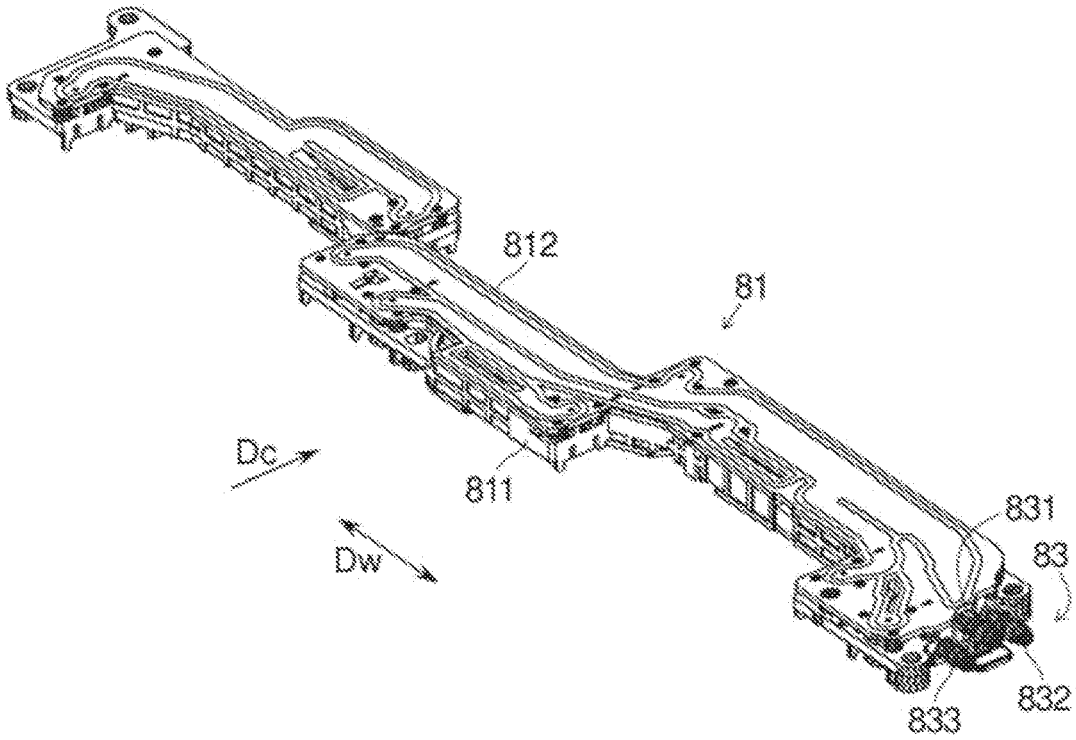
FIG. 9 is a perspective view of the head unit of FIG. 4 as viewed from above the liquid supply unit.
Figure 10:
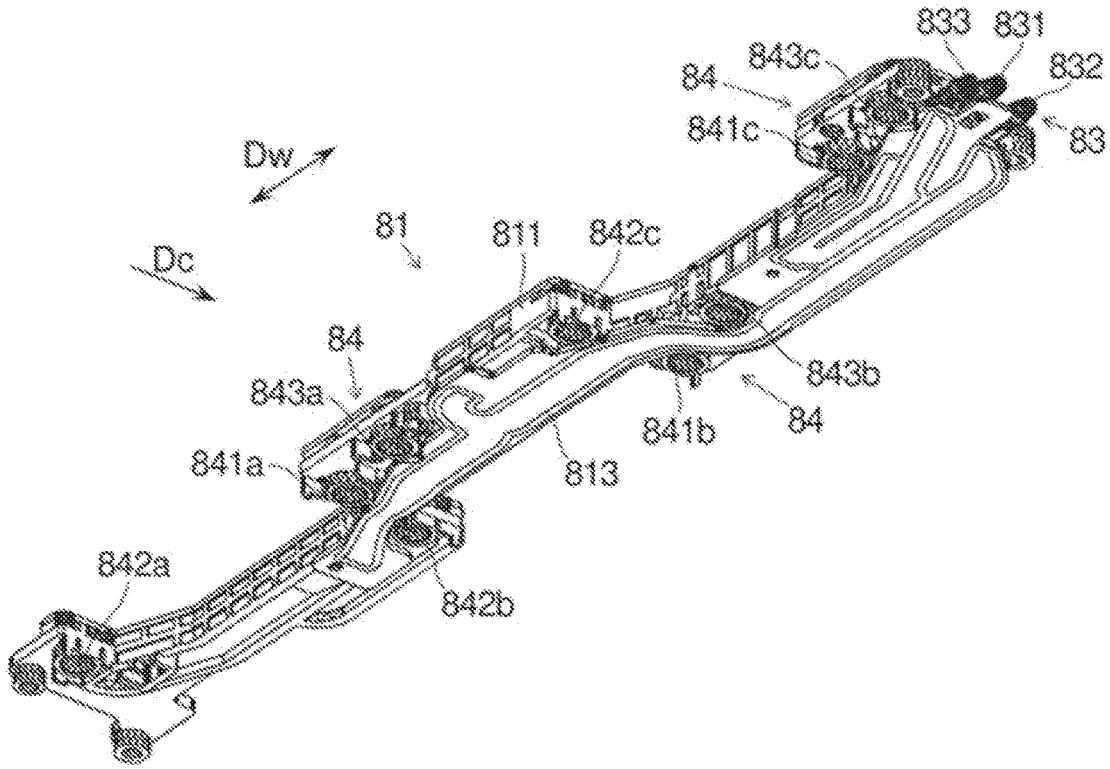
FIG. 10 is a perspective view of the head unit of FIG. 4 as viewed from below the liquid supply unit.
Figure 11:
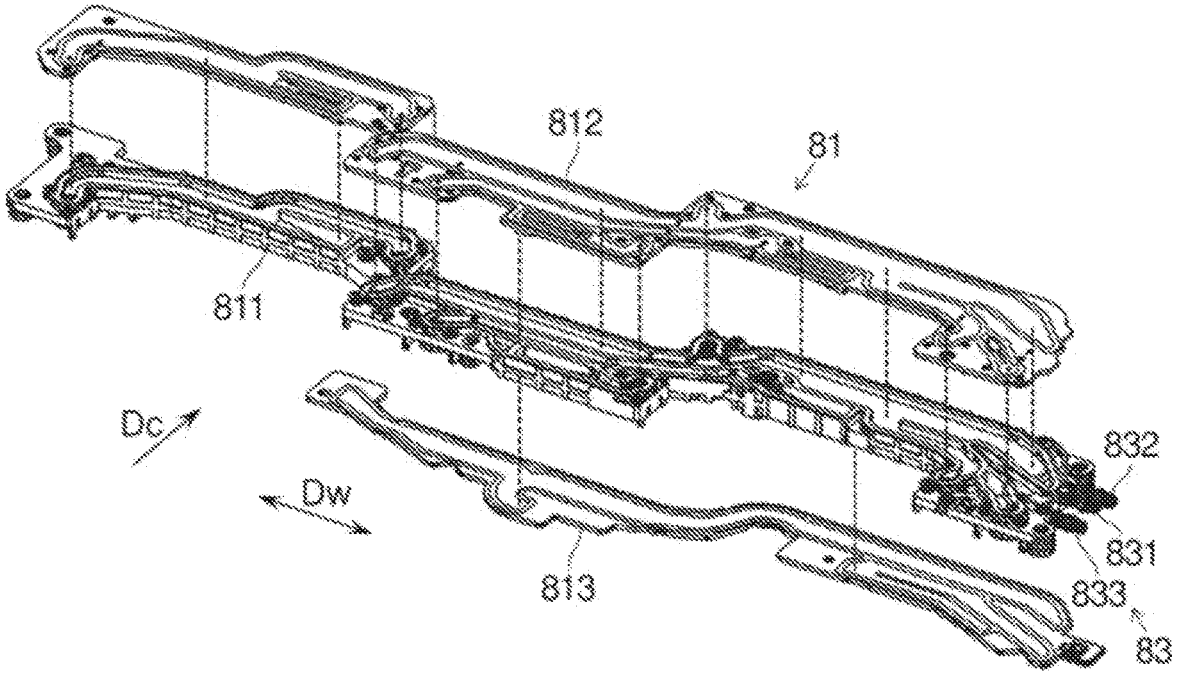
FIG. 11 is an exploded perspective view viewed from above the liquid supply unit of FIG. 9.
Figure 12:
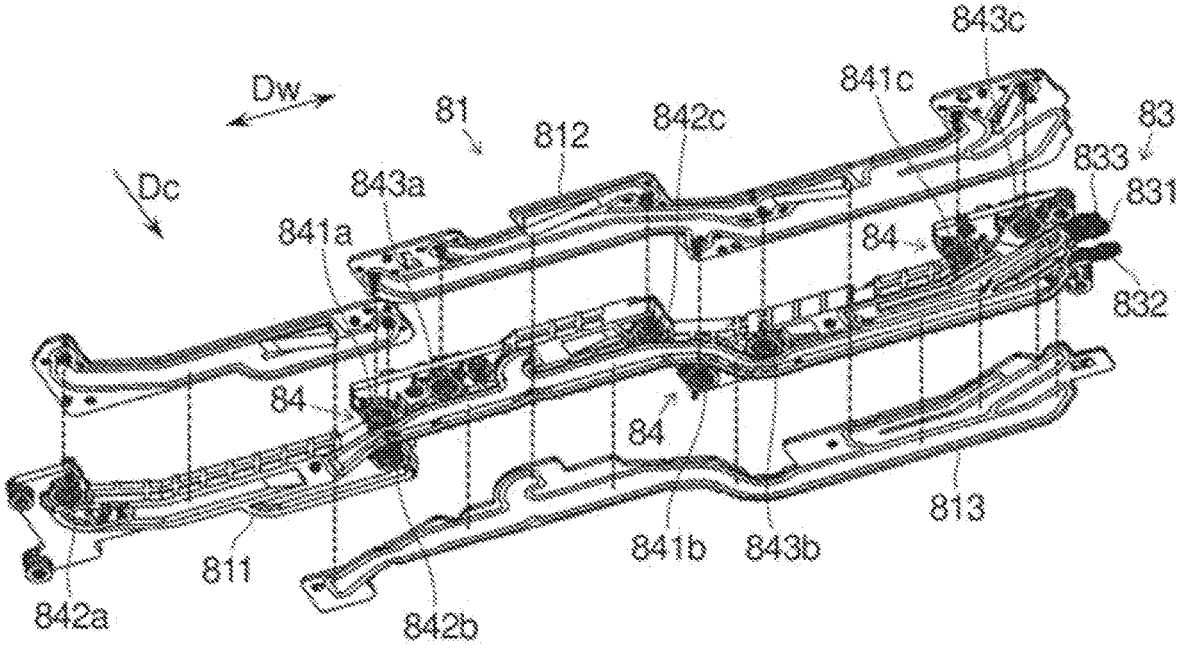
FIG. 12 is an exploded perspective view viewed from below the liquid supply unit of FIG. 9.
Figure 13:
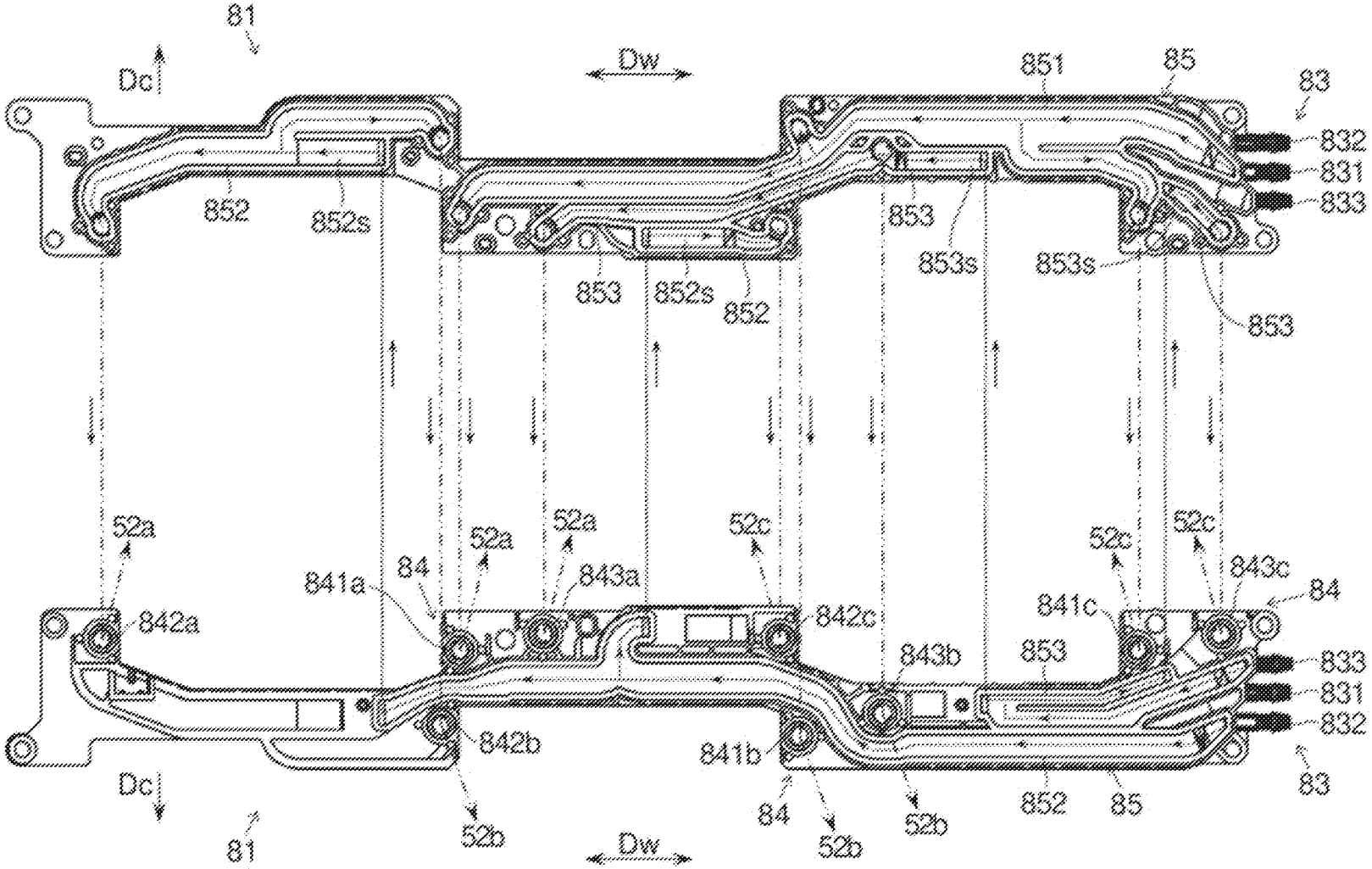
FIG. 13 is a top view and a bottom view of the base member of the liquid supply unit of FIG. 9, and shows a liquid flow path.

Next, the configuration of the liquid supply unit 8 of the head unit 51 will be further described with reference to FIGS. 9, 10, 11, 12, and 13. FIGS. 9 and 10 are perspective views viewed from above and below of the liquid supply unit 8 of the head unit 51 of FIG. 4. FIGS. 11 and 12 are exploded perspective views as viewed from above and exploded perspective views as viewed from below of the liquid supply unit 8 of FIG. 9. FIG. 13 is a top view and a bottom view of the base member of the liquid supply unit 8 shown in FIG. 9, showing a liquid flow path. In these drawings, the drawing of the joint mechanism 82 is omitted.

The liquid supply unit 8 includes an external connection port 83 and a head connection port 84 in addition to the body housing 81 and the joint mechanism 82.

The body housing 81 has thereinside a common flow path 85 through which a liquid passes. In this embodiment, the body housing 81 has three common flow path 85 (851, 852, 853). The common flow path 85 extends in the longitudinal direction (sheet width direction Dw) of the body housing 81.

In this embodiment, the ink and the cleaning liquid pass through the common flow path 85. Specifically, the three common flow paths 85 include a first ink flow path 851, a second ink flow path 852, and a cleaning liquid flow path 853. In the following description, these three liquid flow paths and their connection ports may be collectively referred to as "common flow path 85", "external connection port 83", and "head connection port 84", except when it is particularly necessary to restrict them.

The external connection port 83 is provided in the body housing 81. The external connection port 83 is disposed at one end in the longitudinal direction of the body housing 81. The external connection port 83 communicates with one end of the common flow path 85. In this embodiment, the liquid supply unit 8 has three external connection ports 83 (831, 832, 833) individually provided for the three common flow paths 85.

A piping such as a tube extending from the outside is connected to the outer end of the external connection port 83. The piping is individually connected to three external connection ports 83 (831, 832, 833). The piping is connected to an ink tank and a cleaning liquid tank (both liquid supply sources) outside the head unit 51. Ink or cleaning liquid passes through the external connection port 83.

The head connection port 84 is provided in the body housing 81. The head connection port 84 is arranged on the lower surface of the body housing 81. The head connection port 84 communicates with the other end of the common flow path 85. A head connection port 84 is provided for each of the three recording heads 52*a*, 52*b*, and 52*c* for each of the three common flow paths 851, 852, and 853.

More specifically, in the first ink flow path 851, three head connection ports 841*a*, 841*b*, and 841*c* are individually provided for the respective three recording heads 52*a*, 52*b*, and 52*c*. Similarly, three head connection ports 842*a*, 842*b*, and 842*c* are provided for the second ink flow path 852, and three head connection ports 843*a*, 843*b*, and 843*c* are provided for the cleaning liquid flow path 853. Joint mechanisms 82 (see FIGS. 5 and 6) are individually provided below each of the nine head connection ports 84. Ink or cleaning liquid passes through the head connection port 84.

According to the above configuration, it is not necessary to connect a tube or the like for supplying liquid such as ink or cleaning liquid to each of the three recording heads 52*a*, 52*b*, and 52*c*. In other words, since the body housing 81 of the liquid supply unit 8 is connected to the three recording heads 52*a*, 52*b*, and 52*c*, piping such as a tube is not required. Therefore, the head unit 51 can be easily assembled and the cost can be reduced.

The body housing 81 includes a base member 811, an upper lid member 812, and a lower lid member 813.

The base member 811 is positioned at a center portion in the vertical direction with respect to the upper lid member 812 and the lower lid member 813. In this embodiment, the base member 811 has three common flow path 85 (851, 852, 853). The base member 811 has at least one common flow path 85 at each of the upper and lower portions.

Specifically, the first ink flow path 851 communicating with the external connection port 831 is formed on the upper portion of the base member 811.

The upstream portion and a part of the midstream portion in the liquid flow direction of the second ink flow path 852 communicating with the external connection port 832 are formed on the lower portion of the base member 811. A part of the midstream portion and the downstream portion in the liquid flow direction of the second ink flow path 852 are formed on the upper portion of the base member 811. The second ink flow path 852 has an inclined part 852*s* extending from the lower part to the upper part of the base member 811. In the inclined part 852*s*, ink flows from the lower portion to the upper portion of the base member 811.

A part of the upstream portion in the liquid flow direction of the cleaning liquid flow path 853 communicating with the external connection port 833 is formed on the lower portion of the base member 811. A part of the upstream portion and the downstream portion in the liquid flow direction of the cleaning liquid flow path 853 are formed on the upper portion of the base member 811. The cleaning liquid flow path 853 has an inclined part 853*s* extending from the lower part to the upper part of the base member 811. In the inclined part 853*s*, the cleaning liquid flows from the lower portion to the upper portion of the base member 811.

All of the downstream ends of the three common flow paths 85 in the liquid flow direction and the communicating portions with the respective nine head connection ports 84 are formed on the upper portion of the base member 811. That is, the liquid passing through the nine head connection ports 84 toward the recording head 52 flows downward from the common flow path 85 formed on the upper portion of the base member 811 and passes through the head connection ports 84.

The upper portion of the common flow path 85 formed on the upper portion of the base member 811 is opened. Similarly, the lower portion of the common flow path 85 formed on the lower portion of the base member 811 is opened.

The upper lid member 812 is formed in a plate shape extending in the sheet conveyance direction Dc and the sheet width direction Dw, and is arranged adjacent to the upper surface of the base member 811. The upper lid member 812 covers a common flow path 85 on the upper portion of the base member 811. Thus, the common flow path 85 on the upper portion of the base member 811 is sealed.

The lower lid member 813 is formed in a plate shape extending in the sheet conveyance direction Dc and the sheet width direction Dw, and is arranged adjacent to the lower surface of the base member 811. The lower lid member 813 covers a common flow path 85 on the lower portion of the base member 811. Thus, the common flow path 85 on the lower portion of the base member 811 is sealed.

According to the configuration described above, a plurality of common flow path 85 can be easily formed in the single body housing 81 of the liquid supply unit 8. That is, a plurality of liquids can be supplied to each of the recording heads 52*a*, 52*b*, and 52*c* by using the single body housing 81. With this configuration, the head unit 51 can be easily assembled.

The three common flow path 85 include a first ink flow path 851 and a second ink flow path 852 through which ink passes, and a cleaning liquid flow path 853 through which cleaning liquid passes. According to this configuration, the ink and the cleaning liquid can be supplied to each of the three recording heads 52*a*, 52*b*, and 52*c* by the liquid supply unit 8. Therefore, when the ink and the cleaning liquid are supplied to the recording head 52, processing for piping such as a tube is not required, and the assembly is facilitated and the cost can be reduced.

The ink may be supplied from an external ink tank to the recording head 52 through the first ink flow path 851, and the ink may be circulated from the recording head 52 to the ink tank through the second ink flow path 852. According to this configuration, for example, when image recording can be realized with a small amount of ink, more ink than necessary can be returned to the external ink tank. Therefore, the image can be recorded efficiently.

Typically, an ink supply path or an ink circulation path formed by piping such as a tube is connected to the base end of the flow path. When a plurality of inkjet recording heads are mounted for each color, processing for piping of a tube or the like becomes complicated and assembly becomes difficult. There was also concern that the increased number and length of tubes would increase costs.

According to the configuration of the present disclosure, it is not necessary to connect a tube or the like for supplying liquid such as ink to each of the plurality of recording heads. In other words, since the body housing of the liquid supply unit is connected to the plurality of recording heads, processing for piping such as a tube is not required. Therefore, the assemble of the head unit becomes easy and the cost can be reduced.

Although the embodiments of the present disclosure have been described above, the scope of the present disclosure is not limited thereto, and various modifications may be made without departing from the spirit of the invention.

The invention claimed is:

1. A head unit comprising:

a plurality of recording heads that have a plurality of nozzles which eject ink onto a recording medium; and a liquid supply unit that supplies one or more kinds of liquid, including the ink, to the plurality of recording heads, wherein the liquid supply unit includes:

a body housing that is positioned above the nozzles of the plurality of recording heads and has thereinside a common flow path through which the liquid passes;

an external connection port that is provided in the body housing and communicates with one end of the common flow path, the external connection port being connected to an external liquid supply source so that the liquid passes from one of the common flow path and the external liquid supply source to the other thereof through the external connection port; and a plurality of head connection ports that are provided in the body housing and communicates with the other end side of the common flow path, the plurality of head connection ports being connected respectively to the plurality of recording heads so that the liquid passes from one of the common flow path and each of the plurality of recording heads to the other thereof through the plurality of head connection ports.

2. The head unit according to claim 1, wherein the liquid supply unit includes:

a base member in which a plurality of the common flow paths are formed and at least one of the common flow paths is formed in each of an upper portion and a lower portion of the base member;

an upper lid member that covers the common flow path on the upper portion of the base member; and a lower lid member that covers the common flow path on the lower portion of the base member.

3. The head unit according to claim 2, wherein the plurality of common flow paths include:

an ink flow path through which the ink passes; and a cleaning liquid flow path through which a cleaning liquid for cleaning an ink ejection surface of the recording head passes.

4. The head unit according to claim 3, wherein the ink flow path includes:

a first ink flow path that supplies the ink from the liquid supply source to the recording head; and a second ink flow path that circulates the ink from the recording head to the liquid supply source.

5. An inkjet recording apparatus comprising the head unit according to claim 1.

6. The head unit according to claim 1, wherein the external connection port is disposed at one end of the body housing in a longitudinal direction thereof.

7. A head unit comprising:

a plurality of recording heads that have a plurality of nozzles which eject ink onto a recording medium; and a liquid supply unit that supplies one or more kinds of liquid, including the ink, to the plurality of recording heads, wherein the liquid supply unit includes:

a body housing that is positioned above the nozzles of the plurality of recording heads and has thereinside a common flow path through which the liquid passes;

an external connection port that is provided in the body housing, communicates with one end of the common flow path, is connected to an external liquid supply source, and through which the liquid passes; and a head connection port that is provided in the body housing, communicates with the other end side of the common flow path, is connected to each of the plurality of recording heads, and through which the liquid passes, wherein the liquid supply unit includes:

a base member in which a plurality of the common flow paths are formed and at least one of the common flow paths is formed in each of an upper portion and a lower portion of the base member;

an upper lid member that covers the common flow path on the upper portion of the base member; and a lower lid member that covers the common flow path on the lower portion of the base member, and wherein the plurality of common flow paths include:

an ink flow path through which the ink passes; and a cleaning liquid flow path through which a cleaning liquid for cleaning an ink ejection surface of the recording head passes.

* * * * *